US007585210B2

(12) United States Patent
Yurcak

(10) Patent No.: US 7,585,210 B2
(45) Date of Patent: Sep. 8, 2009

(54) NEGATIVE AIR SUPPLIED (NAS) CRAWLSPACE SYSTEM

(75) Inventor: Michael E. Yurcak, Virginia Beach, VA (US)

(73) Assignee: Mike Yurcak, Virginia Beach, VA (US)

( * ) Notice: Subject to any disclaimer, the term of this patent is extended or adjusted under 35 U.S.C. 154(b) by 0 days.

(21) Appl. No.: 11/698,234

(22) Filed: Jan. 26, 2007

(65) Prior Publication Data

US 2008/0182503 A1 Jul. 31, 2008

(51) Int. Cl.
*F24F 7/013* (2006.01)
*F24F 7/00* (2006.01)

(52) U.S. Cl. ..... 454/228; 454/276

(58) Field of Classification Search ..... 454/139, 454/239, 276, 228
See application file for complete search history.

(56) References Cited

U.S. PATENT DOCUMENTS 5,131,887 A * 7/1992 Traudt ..... 454/255
5,271,242 A * 12/1993 Addington ..... 62/285
5,469,183 A * 11/1995 Takatsuji et al. ..... 345/2.2
6,461,233 B1 * 10/2002 Gilkison et al. ..... 454/57
6,468,054 B1 * 10/2002 Anthony et al. ..... 417/360
2004/0185771 A1 * 9/2004 Hopkins ..... 454/256
2005/0005616 A1 * 1/2005 Bates et al. ..... 62/77
2005/0087614 A1 * 4/2005 Ruise ..... 236/49.3
2005/0186900 A1 * 8/2005 Janesky ..... 454/276

* cited by examiner

*Primary Examiner*—Steven B McAllister
*Assistant Examiner*—Samantha A Miller

(57) ABSTRACT

A system for drying the crawlspace of a home, reducing mold in the crawlspace and in the living area of the home, and that creates healthy air exchanges in the living area of the home with fresh air from the outside. The Negative Air Supplied (NAS) crawlspace system implements multiple drying theories to efficiently dry both porous and semi-porous materials in the crawlspace down to moisture levels too low for mold to grow. The present NAS system also creates a negative air pressure in the crawlspace, which causes the airflow in the home to go from the living area to the crawlspace. This airflow pattern prevents any mold spores in the crawlspace from entering the living area of the home. The airflow created by the NAS system also forces multiple air exchanges per day in the living area of the home with outside air.

20 Claims, 9 Drawing Sheets

| Moisture Readings before installing the N.A.S. Crawlspace System | Moisture Readings after installing the N.A.S. Crawlspace System |
|---|---|
| Area 1: 07/26/2006 22.2% MC | Area 1: 07/31/2006 14.5% MC |
| Area 2: 07/26/2006 20.7% MC | Area 2: 08/04/2006 15.4% MC |
| Area 3: 07/26/2006 24.1% MC | Area 3: 08/04/2006 14.7% MC |
| Area 4: 07/26/2006 27.2% MC | Area 4: 08/07/2006 13.2% MC |
| Area 5: 07/26/2006 20.3% MC | Area 5: 08/04/2006 13.6% MC |
| Area 6: 07/26/2005 20.0% MC | Area 6: 08/07/2006 13.9% MC |

Figure 5

| **Spore count before N.A.S. System** | | **Spore count after N.A.S. System** | |
|---|---|---|---|
| Aspergillus / Penicillium | 77,000 | Aspergillus / Penicillium | 2,920 |
| Basidiospores | 160 | Basidiospores | 0 |
| Bipolaris / Drachslera | 0 | Bipolaris / Drachslera | 0 |
| Culvularia Species | 0 | Culvularia Species | 0 |
| Epicoccum Species | 40 | Epicoccum Species | 0 |
| Pithomyces Species | 0 | Pithomyces Species | 0 |
| Stachybotrys Species | 40 | Stachybotrys Species | 0 |
| Torula Species | 0 | Torula Species | 0 |
| Smuts / Myxomycetes / Periconia | 120 | Smuts / Myxomycetes / Periconia | 80 |
| **TOTAL** | **77,360** | **TOTAL** | **3,000** |
| Samples taken in crawlspace | | Samples taken in crawlspace | |

Figure 6

| **Spore count before N.A.S. System** | | **Spore count after N.A.S. System** | |
|---|---|---|---|
| Alternaria Species | 200 | Alternaria Species | 0 |
| Basidiospores* | 40 | Basidiospores | 0 |
| Bipolaris / Drachslera | 40 | Bipolaris / Drachslera | 0 |
| Culvularia Species | 120 | Culvularia Species | 0 |
| Epicoccum Species* | 80 | Epicoccum Species | 0 |
| Pithomyces Species | 120 | Pithomyces Species | 0 |
| Smuts / Myxomycetes / Periconia | 120 | Smuts / Myxomycetes / Periconia | 40 |
| Stachybotrys Species* | 80 | Stachybotrys Species | 0 |
| Torula Species | 80 | Torula Species | 0 |
| **TOTAL** | **880** | **TOTAL** | **40** |
| Samples taken in living room | | Samples taken in living room | |

* - also present in crawlspace.

Figure 7

| **Spore count before N.A.S. System** | | **Spore count after N.A.S. System** | |
|---|---|---|---|
| Alternaria Species | 0 | Alternaria Species | 0 |
| Aspergillus / Penicillium | 400 | Aspergillus / Penicillium | 80 |
| Smuts / Myxomycetes / Periconia | 120 | Smuts / Myxomycetes / Periconia | 0 |
| **TOTAL** | **520** | **TOTAL** | **80** |
| Samples taken in bathroom | | Samples taken in bathroom | |

Figure 8

NEGATIVE AIR SUPPLIED (NAS) CRAWLSPACE SYSTEM

BACKGROUND OF THE INVENTION

The present invention relates generally to the field of crawlspace drying systems for homes and more specifically to a crawlspace system that employs negative air pressure.

There is one consistent problem with almost all crawlspaces, too much moisture, which can cause significant amounts of mold and wood rot. To make matters worse, the results of air sampling show that the same molds in the crawlspace of a home are also found in the interior of the home. When the humidity in a crawlspace rises above 60% relative humidity (RH), conditions are favorable to saturate wood and cause mold to grow. When the moisture content of wood reaches above 16% moisture content (MC) conditions are favorable for mold to grow. When the moisture content of wood elevates between 28% and 35%, wood rot will occur. In the summer time throughout much of the country, the crawlspace moisture content is between 22% and 38% MC. The climate in much of the country during the summer months cause the humidity to be sustained above 60% RH. This moist, stagnant air gets trapped inside of crawlspaces causing favorable conditions for mold growth and wood rot. Further, many times owners of these homes will go to their doctor with an unexplained sickness that they cannot overcome. Today technology has progressed in the medical field to the point that doctors are able to diagnose when patients are sick from mold and mold spores. In the majority of cases, there is no visible mold in the home, until the crawlspace is inspected. In all of these cases, extensive testing has shown that the same molds that are present in the crawlspace are also present inside of the living area of the home. This occurs for two reasons, homes are not built airtight, and all crawlspaces are under positive pressure, meaning that outside air flows into the crawlspace and then filters into the living area of the home. When air from the crawlspace filters into the home, mold spores are carried with the air. The contaminated air is pushed into the home through openings in the floor such as, plumbing holes, wiring holes, and seams in flooring.

A typical crawlspace has over 50,000 mold spores per cubic meter of air. Safe levels for breathable air are well below 1000 mold spores per cubic meter of air. Depending on the type of mold, even levels below 1000 mold spores per cubic meter of air can be harmful. Generally speaking, the molds that grow from saturated wood are harmful, and they include stachybotryis, and aspergillus/penicillium. To properly remediate a crawlspace with moderate mold damage is very labor intensive and costly, typically $15,000.00 to $20,000.00 to remediate a crawlspace on a 2400 SF home. Once the remediation is complete, a drying system must still be installed or the crawlspace will need to be remediated again within two years. Homeowners and restoration companies have recently made lawmakers aware of this problem and some states have implemented codes that require a crawlspace ventilation system in all new homes.

According to the EPA, "the most effective way to improve indoor air quality is to eliminate or control sources of pollution, or to reduce their emissions. Another important approach that goes hand in hand with controlling pollution is using mechanical ventilation to lower the concentrations of pollutants in your home by increasing the amount of outdoor air coming inside. Good ventilation is important because it protects both your health and your home. Good ventilation protects you and your family from unpleasant odors, irritating pollutants, and potentially dangerous gases. Well-planned ventilation also helps prevent the growth of mold and mildew, which can cause allergic reactions and aggravate lung diseases such as asthma. Too much moisture in a home can lead to mold, mildew, and other biological growth. This in turn can lead to a variety of health effects ranging from more common allergic reactions, asthma attacks, and hypersensitivity pneumonitis, to death. Excess moisture can be in the form of high relative humidity, leaks in the roof, walls, or plumbing, air moving from the inside or the outside into the walls, or from the basement or crawlspace. Methods to control moisture include fixing any water leaks; providing ventilation in the home; air-sealing; properly using vapor barriers in wall construction, roofs; and preventing soil moisture from entering the home through basements and crawlspaces."

The Institute of Inspection Cleaning and Restoration states, "Even high humidity or warm moist air condensing on cool surfaces can trigger mold problems. Create negative pressure to prevent mold from spreading."

Advance Energy addresses the mold problem as follows: "These symptoms are most often noticed in the humid spring and summer seasons but can occur at any time of the year. Often, the heating and air conditioning contractor is the first person the residents call to deal with the problem. Typically though, the problem is not due to a failure of the air conditioning system; it results from poor moisture control in the crawl space."

For many decades, building codes and conventional wisdom have prescribed ventilation with outside air as the primary method of moisture control in crawl spaces. In the humid Southeast, however, ventilation with outside air only makes moisture problems worse. Recent research by Advanced Energy and others indicates that a new type of crawl space system, with NO vents to the outside, can provide greatly improved moisture control and significant energy savings when properly installed. Unfortunately, there is no cost effective system currently available to deal with this problem. What is currently available in the industry is a mix of high priced equipment that comes with an even higher maintenance price. Crawlspace dehumidifiers are expensive, one 60 pint crawlspace dehumidifier, capable of dehumidifying about 5,000 cubic ft of air, cost approximately $3,000.00 to install. Crawlspace dehumidifiers have many problems. The sealing process of the crawlspace must be very precise, meaning very time consuming. Any crack or hole in the crawlspace after the sealing process allows outside air in, and results in the dehumidifier trying to dry an endless supply of humid air, which of course, it cannot. Further, a dehumidifier will only reduce the humidity 15 to 20 percent and they do not work properly in temperatures above 90° Fahrenheit. If the outside humidity is over 80% RH, crawlspace dehumidifiers are ineffective at reducing the humidity to a safe level. Moreover, reducing the humidity in the air will not dry previously moist wood and insulation. High static airflow is needed to pull the moisture out that has wicked into materials such as wood and insulation. When high airflow moves over the surface of a porous material, it creates pressure or a draft and pulls the moisture out of the material. Wood is not very porous therefore is absorbs moisture slowly and also evaporates moisture slowly making it even more difficult to dry. To make matters worse, the exhaust of a dehumidifier will create more positive pressure in a crawlspace enabling more contaminated air to enter the living space of the home. Each dehumidifier runs on about 9 to 13 Amps and generates heat, meaning they are not very cost effective in energy consumption. Dehumidifiers also have a high break down rate because of the conditions in which they operate.

A more involved crawlspace drying system is a sealing and dehumidifying process that involves covering over the foundation walls with a heavy duty plastic material and installing a dehumidifier. The cost can be between $8,000 and $20,000. This system requires that the mold in the crawlspace be remediated before installation. The cost for mold remediation can be between $8,000.00 and $25,000. In addition, because of the construction of a crawlspace (the tight working area, ducting and wiring that covers up portions of moldy wood) it is very difficult and near impossible to fully remediate a crawlspace of mold. Moreover, the heat and positive pressure generated by the dehumidifier creates a bad environment under the home. The crawlspace air is forced into the home and creates an unsound environment and additional heat inside of the home. Any spores, dust, dirt particles and other particulate in a crawlspace environment will also be forced into the living area.

Another prior system involves hanging twenty to twenty-five 150 CFM fans from the rafters of the crawlspace. There is no price range of this system due to the fact it is not on the market however, due to the amount of hardware involved the price is expected to be high, along with the energy consumption. The problems with this system include, the system is untested and hot damp air is brought into the crawlspace from the outside. Further, the system's low CFM air movement will not have the capability to pull moisture out of wood.

There is another system that pulls air from the attic and sends it down into the crawlspace. Problems of this system include the following: the fan blowing into the crawlspace creates positive pressure in the crawlspace; there is not enough air movement to pull moisture out of wood; attic air is very hot and humid, typical relative humidity is around 20% higher than that outside; and, hot air forced under the home rises and enters the home along with contaminated air.

Yet another system involves installing larger foundation vents, fans and exhaust fans. The cost for an average home is around $2,000 to $5,000. Problems with this system include the crawlspaces may remain under positive pressure, hot humid outside air is brought into the crawlspace, and on rainy and humid days moisture content will actually increase in the crawlspace. Further, the equipment is visible from the outside and must be installed into the foundation, which involves cutting through brick and/or solid block.

What is needed in the field is a cost effective crawlspace system that dries the crawlspace and prevents contaminated, moldy air in the crawlspace from moving into the home. The ideal system would create high enough air movements that will pull out moisture that has wicked into wood and insulation. The ideal system would also create negative air in the crawlspace thereby eliminating harmful contaminated air from entering the home and creating healthy air exchanges in the living area of the home with fresh air from the outside.

SUMMARY OF THE INVENTION

A system for drying the crawlspace of a home and for reducing the mold level in the crawlspace and in the living area of the home. The system creates a negative pressure in the crawlspace that generates beneficial air exchanges in the living area of the home. The system comprises, multiple vent covers, at least one floor register, multiple air movers, and at least on exhaust fan. The vent covers are designed to fit over and seal the existing vents of the crawlspace, so that outside air can no longer freely flow into the crawlspace. The floor register provides controlled airflow from the living area of the home into the crawlspace. The floor register includes an upper portion that at least partially extends into the living area and a lower portion that extends into the crawlspace. The lower portion includes a one-way airflow valve that allows air to flow only into the crawlspace. The air movers are strategically placed around the crawlspace so that a circular airflow is created in the crawlspace. The exhaust fan pulls air from the crawlspace and exhausts the air to the outside. The exhaust fan/fans exhaust air from the crawlspace into the atmosphere thereby creating negative pressure in the crawlspace.

In the preferred embodiment: the floor register and the exhaust fan are located on opposite ends of the crawlspace; the floor register provides airflow from the living area to the crawlspace at a rate of 80-120 CFM; and, each vent cover comprises at least two layers, an outer layer made of a durable material and an inner layer made of an insulating material. Further, each air mover preferably comprises a 16-20 inch fan, and each exhaust fan comprises either two 6-10 inch fans or one 16-20 inch fan.

The present system is economically designed to operate on 10-13 Amps of power, depending on the size and number of fans. The optimum placement for the air movers in a rectangular crawlspace is to have an even distribution and position each air mover so that it has a 42 degree angle towards the wall, from a parallel, and a declination of 5 degrees toward the ground, from a parallel. These angles increase the speed of airflow in the crawlspace and provide for a greater distance of air travel. After the present system reduces the mold level in the crawlspace and in the living area of the home, the system is able to maintain the mold levels at a reduced and safe level. The present N.A.S. Crawl System eliminates two of the five items that mold needs in order to grow; moisture and a stagnate environment. The negative pressure created in the crawlspace by the system propagates to the living area of the home causing outside air to enter the living area, through cracks in doorways and window sills and other openings, thereby generating fresh air exchanges in the living area of the home.

It is an object of the present invention to provide an effective drying system for crawlspaces that uses air movers with a unique two-piece design.

It is another object of the present invention to reduce mold levels in the crawlspace and the living area of a home.

It is still another object of the present invention to change the airflow in a home, of from the crawlspace to the living area, to from the living area to the crawlspace.

It is still yet another object of the present invention to generate a negative air pressure in the crawlspace that subsequently cause healthy air exchanges with outside air, in the living area of the home.

BRIEF DESCRIPTION OF THE DRAWINGS

The invention of the present application will now be described in more detail with reference to the accompanying drawings, given only by way of example, in which:

FIG. 1(*b*) shows the airflow in a home with the present system installed in the crawlspace;

FIG. 5 is a moisture content chart that shows readings taken before and after installment of the present system;

FIG. 6 is a chart showing spores counts before and after installment of the present system;

FIG. 7 is a chart showing spores counts before and after installment of the present system;

FIG. 8 is a chart showing spores counts before and after installment of the present system;

DETAILED DESCRIPTION OF THE INVENTION

Figure 1A:
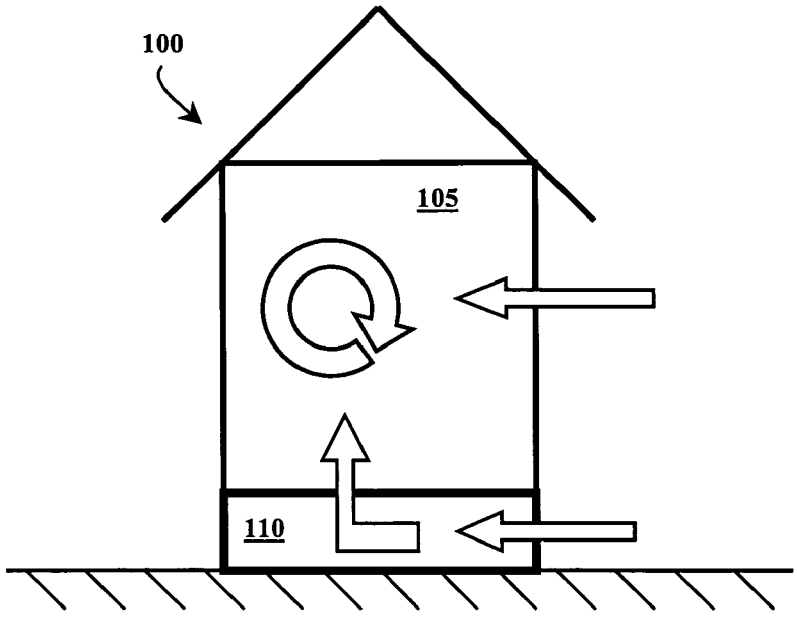
FIG. 1(*a*) shows the airflow in traditional homes with a crawlspace.
Figure 1B:
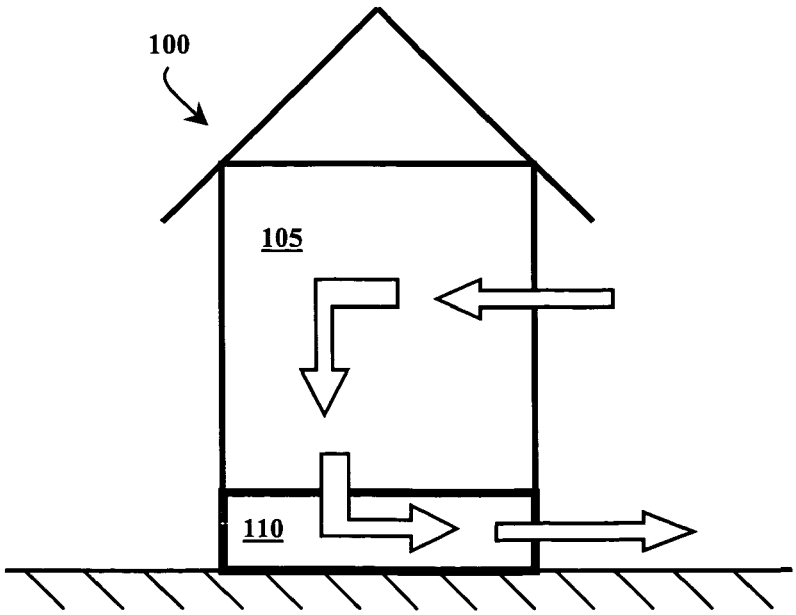

FIG. 1(*a*) shows the airflow in a traditional home 100 with a crawlspace 110. In the traditional home 100, air enters the crawlspace 110 through vents that are provided in the home for the crawlspace. The air becomes heated in the crawlspace, especially in summer months, and enters the living space 105 of the home through cracks, holes and other openings in the floor of the home. Air in the living space 105 of the home gets trapped inside the home and the same unhealthy air re-circulates within the home. Common HVAC filters are not designed to trap harmful particulate that is microscopic like mold. The airflow shown in FIG. 1(*a*) is unhealthy for the occupants of the home because mold spores in the crawlspace 110 are carried with the air into the living are 105 of the home. Increased spore counts in the living area 105 of the home lead to increased sicknesses for the occupants of the home.

FIG. 1(*b*) shows that the airflow is changed in the same home 100 after the present Negative Air Supplied (NAS) Crawlspace system has been installed in the crawlspace 115. The present system creates a negative pressure in the crawlspace 115, relative to the living area 105 of the home, which stops air in the crawlspace from moving into the living area 105 of the home. After the present system is installed, air moves out of the living area 105 of the home and into the crawlspace 115 of the home, and later is exhausted to the outside. The air movement created by the present system dries any standing water in the crawlspace 110, and also wicks moisture out of wood and other materials in the crawlspace 110 to create a moisture free environment, as far as mold is concerned. Mold needs a moisture content (MC) level that is above 16% in order to grow and survive. There are also four other essential elements that must be present in any crawlspace for mold to survive: food, the proper temperature, a stagnate environment, and time. Eliminate any one of the essential elements and mold is stopped. The present N.A.S. Crawl System eliminates two of these essential elements: moisture; and, a stagnate environment.

Figure 2:
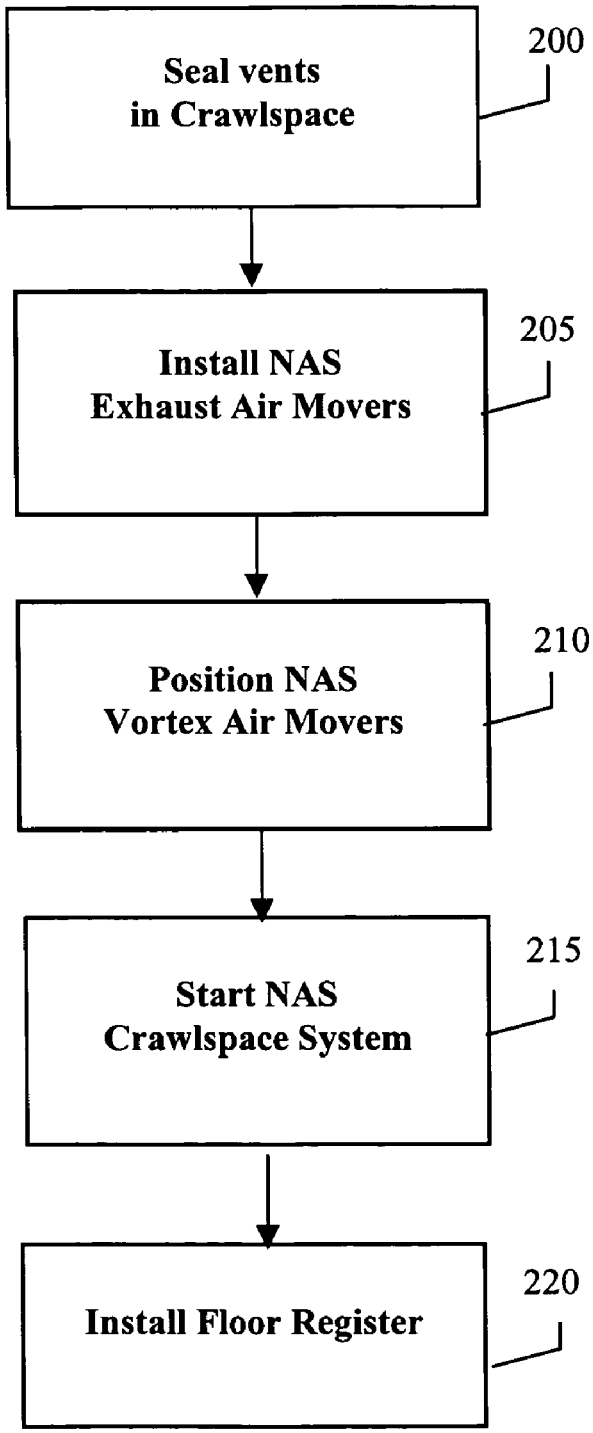
FIG. 2 is a flow chart showing exemplary steps in the present method.

FIG. 2 is a flow chart showing exemplary steps in the present method for drying and reducing spore counts in the crawlspace of a home. In step 200 the vents in the crawlspace that lead to the outside are sealed closed. Insulated vent covers, discussed further below, are provided in the present system and are used to seal the vents. In step 205 the exhaust fans are installed. The exhaust fans suck air out of the crawlspace and exhaust the air to the outside through exhaust vents. The air exhausted out of the crawlspace creates the beneficial negative pressure in the crawlspace. Each exhaust vent includes a louver that acts as a one-way airflow valve, which allows air to exit to the outside, but prevents outside air from entering the crawlspace. In step 210 the air movers are strategically placed in the crawlspace so that a circular airflow, or vortex, is created within the crawlspace when the air movers are turned on. The optimum placement for the air movers in a rectangular crawlspace is to have an even distribution of air movers next to the longest walls in crawlspace. Each air mover should be positioned at a 42 degree angle towards the wall, and with a declination of 5 degrees toward the ground. These angles increase the speed of airflow in the crawlspace and provide for a greater distance of air travel. In the preferred embodiment, the air movers are circular fans with protective screens and a special two-part housing, or shroud, that allows the large fans to enter through traditional 16"×24" crawlspace doors. The multi-functional housing also allows the air movers to be freestanding. In step 215 the air movers and exhaust fans are started and the air in the crawlspace is allows to circulate and exhaust to the outside. After approximately 15-20 minutes, in step 220, a floor register is installed in the bottom floor of the home; the floor immediately above the crawlspace. Of course, the floor register can be installed in an earlier step and the one-way valve held closed until step 220. The floor register acts as the intake valve for the present NAS system and includes a one-way airflow valve that allows air to flow into the crawlspace but prevents air from leaving the crawlspace and entering the living area of the home.

Closing and sealing the vents eliminates the main reason why crawlspaces retain moisture. The present vent covers keep out the majority of hot humid air, then the air movers of the present system cool and evaporate the remaining air. Air at a high velocity creates friction or a vapor pull on the surfaces it flows over. This pulls the moisture from the porous or semi porous materials in the crawlspace. Dehumidified air (80 to 120 CFM) enters the crawlspace through the floor register and helps cool and evaporate the moisture in the air. Cooler air lowers the GPP (grain per pound) grains of moisture in the air that aids in pulling the trapped moisture out of wood, insulation and other materials in the crawlspace. In addition the lower temperatures created in the crawlspace have a radiant effect on the home that helps keep the home cooler in the summer and helps in energy savings.

Figure 3:
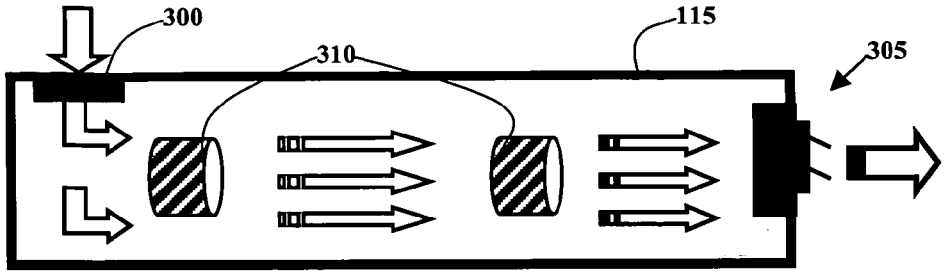
FIG. 3 shows a side view schematic of a crawlspace with exemplary equipment of the present system installed.

FIG. 3 is a side view schematic of exemplary equipment in the present system. The figure also shows the airflow that is achieved in a crawlspace 115 with the present system. Air from the living area of the home enters the crawlspace 115 via at least one floor register 300. Air movers 310 continuously move the air in the crawlspace. The air is eventually exhausted to the outside via at least one exhaust fan 305. The preferred exhaust fans include moveable louvers on their exterior that open when air is being exhausted from the crawlspace 115 and automatically shut when air is not being exhausted, thus preventing outside air from entering the crawlspace.

Figure 4:
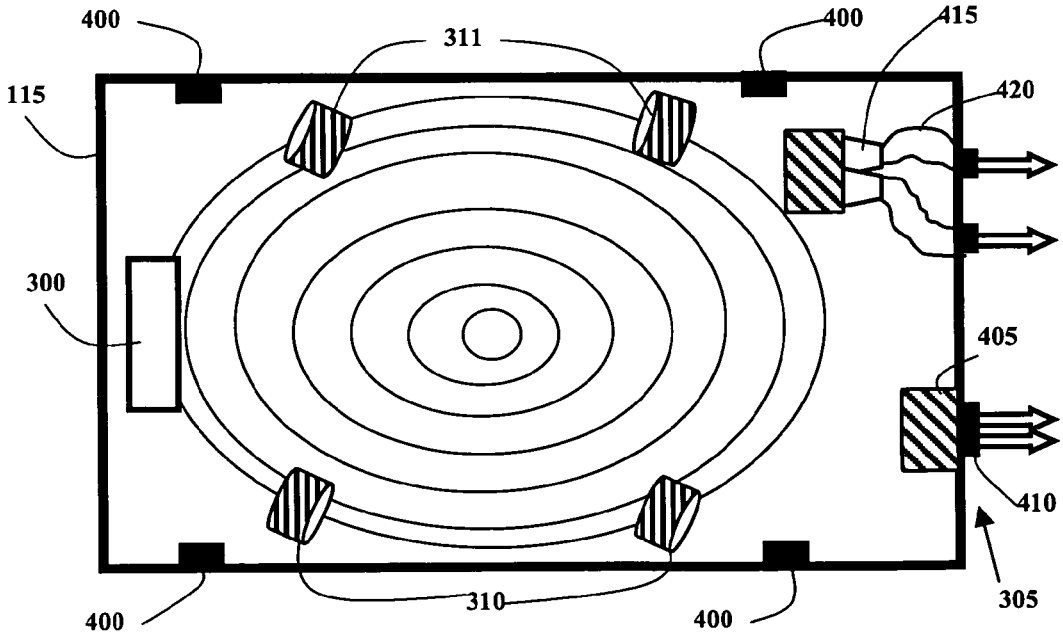
FIG. 4 is a top view of the crawlspace.

FIG. 4 is a top view schematic of the crawlspace 115 with the preferred embodiment of the NAS Crawlspace System installed. The vents of the crawlspace 115 have been covered and sealed closed with vent covers 400. Air from the living area of the home enters the crawlspace 115 via floor register 300. Air movers 310 & 311 circulate the air around the crawlspace 115 so that a vortex is created in the crawlspace. The air movers can be placed at various angles, however Applicant has found the angles described above to provide optimum circulation for crawlspaces with a rectangular shape. Air is removed from the crawlspace 115 by exhaust fans 305. Each exhaust fan includes a fan portion 405 that may include more than one fan, and an exhaust vent 410 that replaces the standard vent. In the preferred embodiment, the air movers 310 & 311 are 18" circular fans, and the fan portion 405 of the exhaust fan includes two 8" circular fans. Exhaust fans may also include an exhaust port 415 and exhaust ducting 420 that leads to an exhaust vent. The air movers 310 & 311 and the fan portions 405 each have a two-piece cylindrical housing that provides for mounting, allows access to the mechanical portions of the fans for maintenance, and provides the ability to fit through a standard crawlspace entrance. The exhaust vent 410 of the exhaust fan 305 may also include two ports through which air is exhausted to the outside. Each exhaust vent preferably includes a one-way airflow valve (louvers) that allows air to exit the port but prevents air from re-entering.

After moisture levels are reduced in the crawlspace, mold reduction occurs. High airflow provided by the NAS Crawlspace System pulls mold spores off of the hyphae or stems. Exhausting air sends the mold spores in the air to the outside atmosphere. Air exchanges bring in clean air that replaces the contaminated air. In addition the air in a home that contains mold, dust, pet dander, carbon dioxide, carbon monoxide and other harmful contaminates is also replaced with cleaner air from the outside. The present NAS Crawlspace System is designed to impede moisture intrusion, evaporate present moisture, dry floor joists, sub floors, and insulation, and reduce spore counts in the crawlspace and inside of the home. The present system utilizes multiple drying theories to create a drying chamber in the crawlspace. Air movement and negative air pressure lead to significant reduction in moisture levels, airborne particulate and mold spores. The NAS Crawlspace System is also designed for quick installation and is not labor intensive. This system is the only one of its kind that can guarantee dry conditions in a crawlspace, and reduced spore counts in the air of the crawlspace and in the interior of the home. The system also creates air exchanges inside of the home, as recommended by the EPA. The NAS Crawlspace System is completely hidden inside of the crawlspace. The air movers are specifically designed to operate in this environment. The entire system can operate on as little as 10 Amps of electrical power. The energy savings of a cooler home created by the system will offset the cost of running the system. It is an affordable and effective way to maintain safe moisture levels along with improving air quality. As FIGS. 5-7 will show, the present system has been tested and proven to significantly reduce moisture content levels, and mold spores in both the crawlspace and the living area of the home.

FIG. 5 shows the moisture content of wood in six different areas of a crawlspace where the present NAS system was installed. The figure shows that the moisture content of wood in some areas of the crawlspace were reduced to less than 16% (not enough for mold to grow) in just 5 days. The figure further shows that all wood in all areas of the crawlspace had their moisture content reduced to under 16% in just 12 days. The moisture readings were taken with a G.E. Protimeter, Model BLD5800LH, that was calibrated before each use.

FIG. 6 is a chart showing spore counts in the crawlspace of a home both before and after installation of the present NAS Crawlspace System. The first column in the chart shows that the total spore count in the crawlspace of this home, before installation of the present system, was 77,200. The second column in the chart shows the spore count in the crawlspace after installation of the present system was reduced to 3,000. This represents a reduction in spore count by over 96% in the crawlspace of the home. The post installation spore count was taken 5 days after installment of the present system.

FIG. 7 is a chart showing spore counts in the living room of a home both before and after installation of the present NAS Crawlspace System. The first column in the chart shows that the total spore count in the living room of the home, before installation of the present system, was 880. The second column in the chart shows the spore count in the living room after installation of the present system was reduced to 40. This represents a reduction in spore count by over 95% in the living room of the home. It is important to point out that many of the mold spores that were detected in the living area of the home were the same mold spores that were also detected in the crawlspace of the home. These common spores are indicated with an asterisk (*) in the figure. The post installation spore count was taken 5 days after installment of the present system.

FIG. 8 is a chart showing spore counts in the bathroom of a home both before and after installation of the present NAS Crawlspace System. The first column in the chart shows that the total spore count in the bathroom, before installation of the present system, was 520. The second column in the chart shows the spore count in the bathroom after installation of the present system was reduced to total of 80. This represents a reduction in spore count by 85% in a bathroom, which inherently, regularly contains a moist environment. Such a reduction represents the power and effectiveness of the present invention. The post installation spore count was taken 5 days after installment of the present system.

The negative air aspect of the present system is generated by the exhaust fans that are used to pull and exchange air from the crawlspace. The CFM of air exhausted out of the crawlspace creates the negative pressure in the crawlspace. The floor register allows the home to have a slight negative pressure that also allows the air in the living area to be exchanged with fresh air from outside. Air in a 2,400 SF home can be exchanged 7 to 8 times per day, with the present system.

Figure 9:
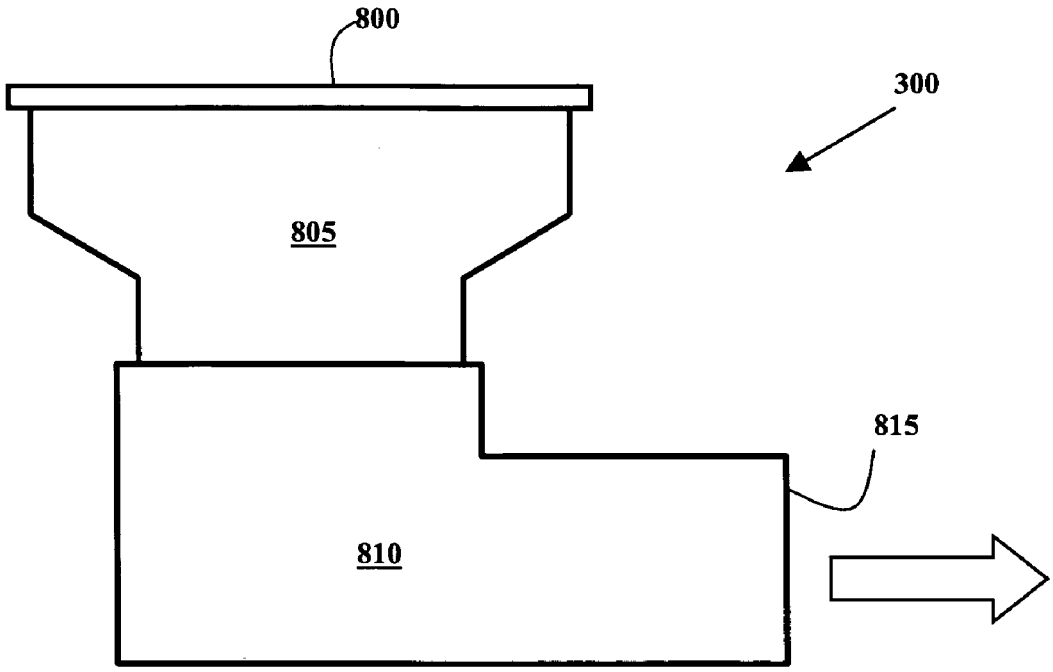
FIG. 9 is a side view of the preferred floor register with ducting.

FIG. 9 is a side view of the preferred floor register 300. The floor register 300 includes a bezel 800 that allows mounting of the register in the floor of the home, and two ducting sections 805 & 810. The upper ducting section 805 connects the bezel 800 to the lower ducting section 810, which extends into the crawlspace. The lower ducting section 810 includes a one-way airflow valve 815 in its lower opening that allows air to enter the crawlspace but prevents air from exiting the crawlspace. The one-way airflow valve 815 is preferably a simple dual-flap, or moving louver, mechanism. In the preferred embodiment, the airflow valve 815 includes a stop that limits how far the valve can open. The stop allows a limit to be placed on the maximum amount of airflow that is allowed into the crawlspace.

Figure 10:
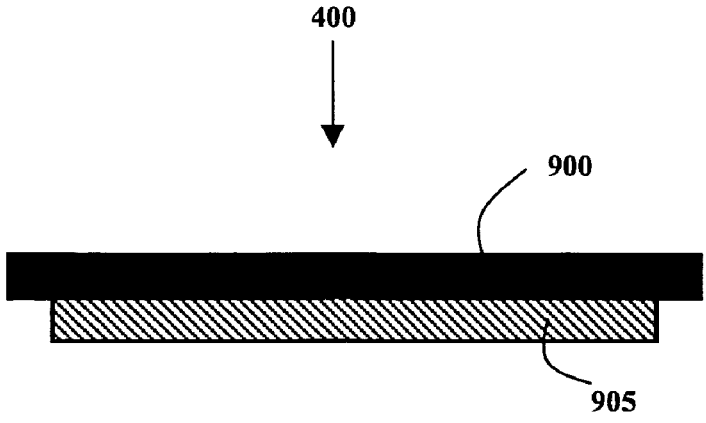
FIG. 10 is a side view of the preferred vent cover.

FIG. 10 shows the preferred vent cover 400 that is used to cover and seal existing vents in the crawlspace. The vent cover 400 includes a hard plastic layer 900 that is exposed to the outside and an insulation layer 905 that faces inward toward the crawlspace. The vent covers can be customized to fit non-standard sized vents and the covers can be installed using traditional attachment means including, adhesives, epoxies, screws, nails or a combination of means.

Figure 11A:
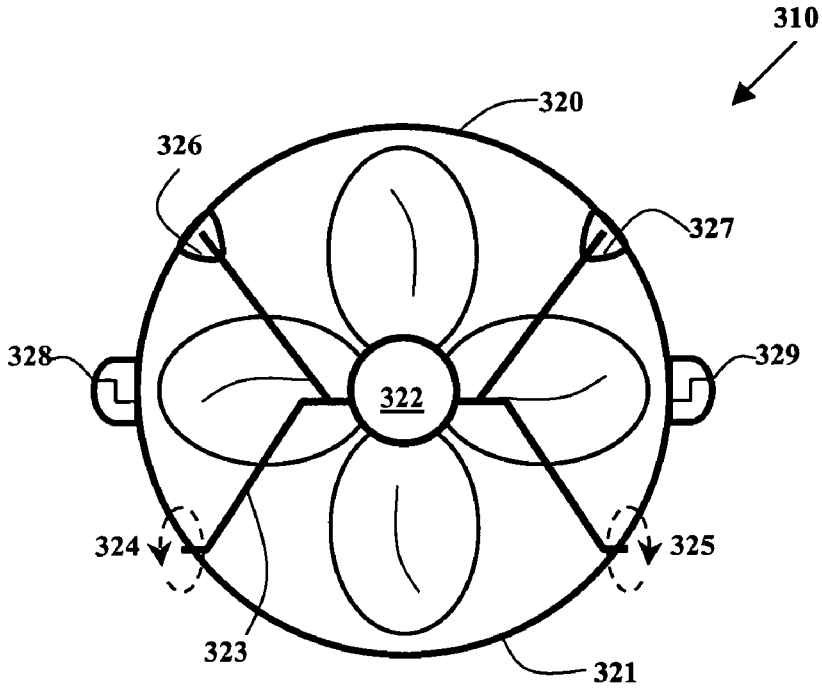
FIGS. 11(*a*) & (*b*) show an exemplary two-part air mover.
Figure 11B:
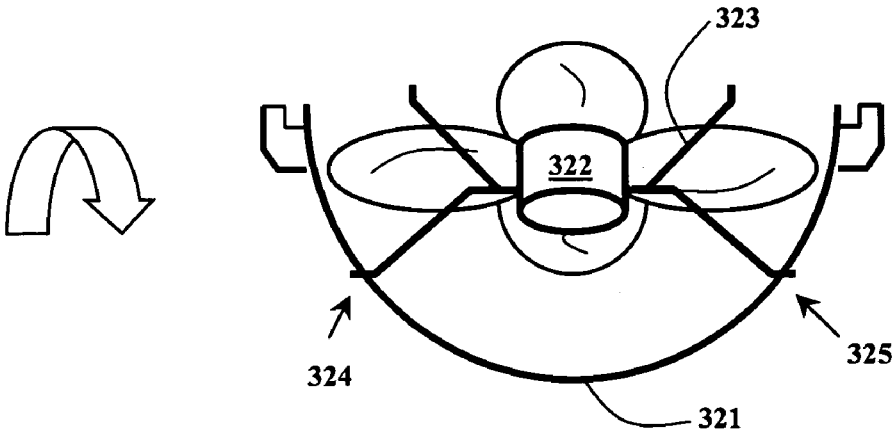

FIG. 11(*a*) shows the back of an exemplary vortex creating air mover 310 with novel two-piece housing, or shroud, 320 & 321. The upper half of the shroud 320 releasably engages with the lower half of the shroud 321 along engagement seams 328 & 329. Within the shroud 320 & 321, the fan housing 322 is supported, and held in a central location, by a rotate-able support bracket 323. The bottom connection points 324 & 325 of the support bracket 323 allow for the bracket, and the fan, to rotate when the top of the support bracket 323 is disconnected from the upper half of the shroud 320. The upper half of the shroud 320 includes connecting tabs 326 and 327 that releasably engage the top of the support bracket 323. The CFM for the air mover 310 is between 1460 and 2870, and the Amp draw is from 1.55 to 2.6, both depending upon the fan size and number of blades. The number of air movers used, and the size of the air movers, will depend upon the size of the crawlspace in which the present system is to be installed.

FIG. 11(*b*) shows the assembled lower half of the air mover shown in FIG. 11(*a*), with the fan housing 322 rotated in a lowered position. The unique design of the present two-piece air mover enables the fans to fit into a standard crawlspace opening, which is only 16"×24". The fan housing 322 and support bracket 323 are allowed to swivel downward, because of connection points 324 & 325, to allow the lower half of the shroud 321, and the main part of the air mover, to gain entry into the crawlspace. The support bracket 323 and fan housing 322 are then stood up and the top of the support bracket 323 is re-attached to the upper half of the shroud, once inside the crawlspace. The cylindrical shroud of the air mover is important as it provides the fan with static pressure; the ability to push air a long distance at a high velocity. This long distance, high velocity air movement is what provides the friction and vapor pull that pulls moisture out of porous materials. The preferred air mover is designed for a quick assembly inside of the crawlspace by simply standing the support bracket 323 up, attaching the upper half of the shroud with 2 wing nuts, attaching the fan guards, and plugging in the wires for power. The wing nuts, fan guards and power cord are not shown for clarity purposes. The preferred two-piece air mover takes less than 2 minutes to assemble inside of the crawlspace. The present air mover is specifically designed for crawlspace drying and the N.A.S. Crawl System. The motor is a TENV (totally enclosed vented) motor that is capable of operating efficiently in a humid environment. The TENV motor also has a very low amp draw.

The present NAS Crawlspace System provides a cost-effective answer to the mold problem in many homes. The system's high-speed air movement provides efficient drying of all materials, yet the system operates on 10-13 Amps of power. Plus, the cooling effect provided by the evaporation reduces the home's air conditioning bill during summer months, which can offset the cost of running the system.

The foregoing description of the specific embodiments will so fully reveal the general nature of the invention that others can, by applying current knowledge, readily modify and/or adapt for various applications such specific embodiments without departing from the generic concept. For example, the present system could include an embodiment wherein two vortexes are created in the crawlspace of an irregularly shaped house. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A system for drying a crawlspace in a home and for reducing a mold level in the crawlspace and in a living area of the home, wherein a negative air pressure that is created in the crawlspace generates a negative air pressure in the living area of the home thereby creating beneficial air exchanges in the living area of the home with fresh air from outside the home, the system comprising:

multiple vent covers, wherein the vent covers are designed to fit over and seal existing vent openings in the crawlspace so that outside air can no longer freely flow into the crawlspace, and wherein the vent covers aid in changing the air pressure in the crawlspace from positive to negative;

at least one floor register that provides controlled airflow from the living area of the home into the crawlspace so that the negative air pressure in the living area is created, each floor register having an upper portion that at least partially extends into the living area and a lower portion that extends into the crawlspace, wherein the lower portion includes a one-way airflow valve;

an array of multiple air movers inside of the crawlspace with substantially equal spacing send air from one air mover to another so that a circular airflow of at least 1,400 CFM is created in the crawlspace wherein, each air mover comprises a fan, an upper and lower shroud that can be separated into top and bottom halves, and a support bracket that supports the fan within the shroud, each air mover is capable of being at least partially disassembled so that each can fit through a standard crawlspace door; and, at least one exhaust fan that pulls damp air from the crawlspace and exhausts the damp air to an outside thereby generating the negative air pressure in the crawlspace, the negative air pressure in the crawlspace creating a pull of air from the living area, through the floor register and into the crawlspace, wherein each of said at least one exhaust fan includes an exhaust vent that is adapted to fit within an existing vent opening in the crawlspace and wherein, each exhaust vent includes a one-way valve that prevents outside air from entering the crawlspace, and further wherein air from the living area circulates in the crawlspace before being exhausted to the outside.

2. The system of claim 1, wherein the at least one floor register and the at least one exhaust fan are located on opposite ends of the crawlspace, and wherein the fans of the multiple air movers and the at least one exhaust fan all have four blades or less.

3. The system of claim 1, wherein the at least one floor register provides airflow from the living area to the crawlspace at a rate of 80-120 CFM, and wherein the one-way valve in the exhaust vent is a set of louvers.

4. The system of claim 1, wherein each vent cover comprises at least two layers, an outer layer made of a durable material and an inner layer made of an insulating material, and wherein the at least one exhaust fan is adapted for attachment to a joist in the crawlspace and is adapted to be plugged into an outlet in the crawlspace.

5. The system of claim 1, wherein the fan of each air mover releasably attached to the top half of the two-piece shroud by the support bracket, and the rotateably attached to the bottom half of the shroud by the support bracket, and wherein the fan comprises a 16-20 inch fan.

6. The system of claim 1, wherein the at least one exhaust fan is a 6-20 inch fan, and wherein the exhaust fan is connected to the exhaust vent by exhaust ducting.

7. The system of claim 1, wherein the an upper and lower shroud has a circular shape, and wherein the system draws no more than 13 Amps of power for normal operations.

8. The system of claim 1, wherein each air mover is angled 42 degrees from an axis parallel to the wall and angled 5 degrees down from a vertical axis.

9. The system of claim 1, wherein after the system reduces the mold level in the crawlspace and in the living area of the home, the system is able to maintain the mold level at a reduced and safe level.

10. The system of claim 1, wherein the negative pressure created in the crawlspace propagates to the living area causing outside air to enter the living area through cracks in doorways and window sills and other openings, thereby generating fresh air exchanges in the living area of the home.

11. A method for drying a crawlspace of a home and for reducing mold levels in the crawlspace and in a living area of the home, wherein negative pressure created in the crawlspace generates beneficial air exchanges in the living area of the home, the method comprising the steps of:

sealing existing vent openings in the crawlspace that lead to an outside with vent covers so that outside air is no longer able to flow into the crawlspace, wherein the sealing of the vent openings aids in changing the air pressure in the crawlspace from positive to negative;

exhausting air in the crawlspace to the outside with at least one exhaust fan so that a negative air pressure is created in the crawlspace, wherein air is exhausted through at least one exhaust vent that is adapted to fit within an existing vent opening in the crawlspace, the negative air pressure in the crawlspace creating a pull of air from the living area into the crawlspace;

creating a circular flow of air in the crawlspace with multiple air movers that are positioned along at least two walls with substantially equal spacing of the crawlspace wherein, each air mover comprises a fan, an upper and lower shroud that can be separated into top and bottom halves, and a rotatable support bracket that holds the fan within the shroud, each air mover is capable of being at least partially disassembled so that each said air mover can fit through a standard crawlspace door; and, providing an air intake for the crawlspace, wherein the air intake allows air from the living area to enter the crawlspace in a controlled manner, and further wherein the air from the living area circulates in the crawlspace before being exhausted to the outside.

12. The method of claim 11, wherein the air intake and the at least one exhaust fan are located on opposite ends of the crawlspace, and wherein the fans of the multiple air movers and the at least one exhaust fan all have four blades or less.

13. The method of claim 11, wherein the air intake provides airflow from the living area to the crawlspace at a rate of 80-120 CFM, and wherein the at least one exhaust vent includes a set of louvers that act as a one-way airflow valve.

14. The method of claim 11, wherein each vent cover comprises at least two layers, an outer layer made of a durable material and an inner layer made of an insulating material.

15. The method of claim 11, wherein the support bracket of each air mover is releasably attached to the top half of the shroud and rotate-ably attached to the bottom half of the shroud, and wherein the fan comprises a 16-20 inch fan.

16. The method of claim 11, wherein the at least one exhaust fan is a 6-20 inch fan, and wherein the exhaust fan is connected to the exhaust vent by exhaust ducting.

17. The method of claim 11, wherein the shroud has a circular shape, and wherein the air movers and the at least one exhaust fan operation on 10-13 Amps of electrical power.

18. The method of claim 11, wherein the step of creating a circular flow further comprises the step of: angling each air mover 42 degrees from an axis parallel to the wall and angled 5 degrees down from a vertical axis.

19. The method of claim 11, wherein after the system reduces the mold level in the crawlspace and in the living area of the home, the system is able to maintain the mold level at a reduced and safe level.

20. The method of claim 11, wherein the negative pressure created in the crawlspace propagates to the living area causing outside air to enter the living area through cracks in doorways and window sills and other openings, thereby generating fresh air exchanges in the living area of the home.

* * * * *